United States Patent [19]

Rusteberg

[11] 4,350,253

[45] Sep. 21, 1982

[54] BOTTLE STORAGE RACK

[75] Inventor: Robert K. Rusteberg, Barrington Hills, Ill.

[73] Assignee: Panlmatic Company, Elk Grove Village, Ill.

[21] Appl. No.: 161,045

[22] Filed: Jun. 19, 1980

[51] Int. Cl.[3] ..... A47B 73/00

[52] U.S. Cl. ..... 211/74; 232/41 E; 248/312

[58] Field of Search ..... 211/74, 71, 72, 39, 211/184, 10, 60 A, 60 M, 65; 40/124; 232/41 A, 41 E; 248/312

[56] References Cited

U.S. PATENT DOCUMENTS

| | | | |
|---|---|---|---|
| 1,242,017 | 10/1917 | Mendelsohn | 211/39 |
| 1,597,235 | 8/1926 | Krieger | 248/312 |
| 2,645,127 | 7/1953 | Parks | 211/184 UX |
| 2,996,938 | 8/1961 | Holtzclaw et al. | 248/312 |
| 3,300,055 | 1/1967 | Rohr | 211/74 |
| 3,356,229 | 12/1967 | Rhymes | 211/60 M |

FOREIGN PATENT DOCUMENTS

| | | | |
|---|---|---|---|
| 18215 | of 1914 | United Kingdom | 211/60 M |

*Primary Examiner*—Ramon S. Britts
*Assistant Examiner*—Ramon O. Ramirez
*Attorney, Agent, or Firm*—Robert E. Wagner; Ralph R. Rath

[57] ABSTRACT

A bottle rack includes a vertical support member supported on a pair of spaced parallel mounting members and a bottle engaging arm that extends outwardly from the support member at an acute angle of about 20° to about 50° with indentations in the arm to receive the necks of bottles so that indicia on the bottles is in full view to the user of the rack.

5 Claims, 7 Drawing Figures

BOTTLE STORAGE RACK

TECHNICAL FIELD

This application relates to a means for storing bottles and, in particular, relates to a rack for holding small bottles.

BACKGROUND OF THE PRIOR ART

In the processing of specimen samples, such as in chemical analytical laboratory work, or the processing of what is commonly known as soft contact lenses, it is necessary that a large number of the specimen bottles be handled together. These bottles are generally identified by different indicia on each bottle for indicating the particular solution, agent, contact lens or the like, contained in the bottle. In the processing or analysis of the contents of each bottle, it is generally standard practice to keep an accurate record of the location and history of each bottle. For these reasons, accessibility to and location of the indicia on each bottle becomes very important in the processing of the bottles. In order to facilitate reading the indicia on the bottles, various practices have been employed, including locating the indicia on the bottle cap, placing the bottles in support stands with adjacent rows offset, and utilizing only single-row holders. However, none of the above allows the hands-off reading of the indicia of each bottle in the holder which can accommodate a plurality of rows of bottles.

SUMMARY OF THE INVENTION

Therefore, an object of the subject invention is a specimen bottle holder which can accommodate a plurality of rows of bottles and provide for the reading of the indicia on each bottle without contact by the reader.

Another object of the subject invention is a bottle holder rack for a plurality of bottles which presents each bottle at an angle for easy reading of the bottle indicia.

Yet another object of the subject invention is a bottle holder rack which is autoclavable.

These and other objects are attained in accordance with the present invention wherein there is provided a bottle holder rack formed of autoclavable material which, in general, comprises holding means mounted transversely between two parallel legs. The holding means has an upright member with a lower end portion engaging each of the legs and the upper end portion supporting a cantilever arm. The arm is notched or indented along its length for accepting or engaging the neck of a specimen bottle. The cantilever arm extends upwardly at a 20° to 50° angle from the horizontal and holds each bottle at such angle. As a result, the indicia on the body of the bottle is visible to a lab technician or other person recording the bottle data immediately in a hands-off manner. Thus, the indicia for the entire series of bottles may be recorded at one time without picking up individual bottles or constantly repositioning the bottle rack.

BRIEF DESCRIPTION OF SEVERAL VIEWS OF DRAWINGS

Further objects of the invention together with additional features contributing thereto and advantages accruing therefrom will be apparent from the following description of one embodiment of the invention when read in conjunction with the accompanying drawings wherein.

DETAILED DESCRIPTION

Figure 1:
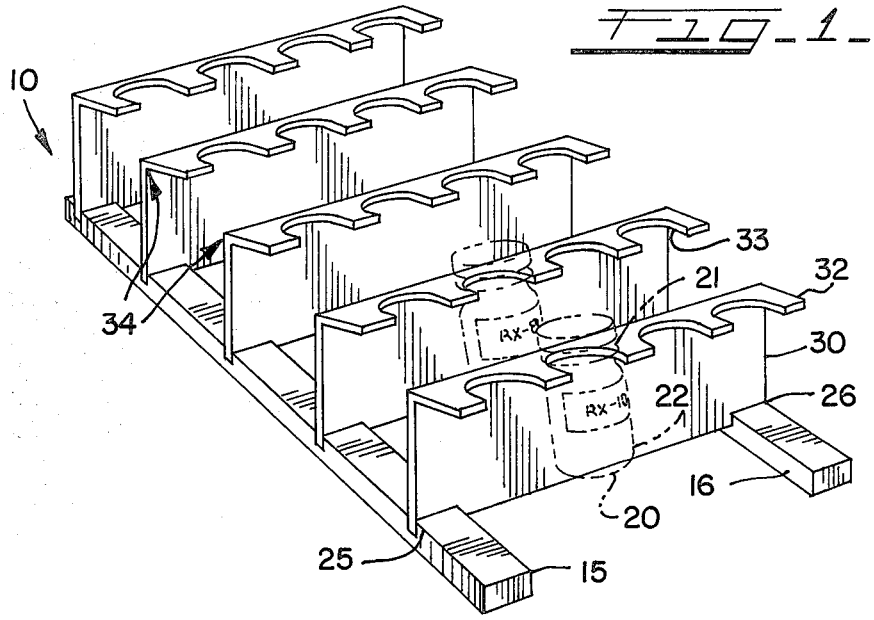
FIG. 1 is a perspective view of one embodiment of the subject invention.

Referring now to FIG. 1, there is shown a bottle holder 10 having a plurality of bottle engaging units 34. While each bottle engaging unit 34 is shown as having a capacity of engaging and holding four bottles, it should be understood that the capacity of each unit may be as few as one or two bottles or as great as a dozen or more, being limited only in extraneous considerations, such as shelf space, autoclave or oven space or the like. Each bottle holding means 34 is mounted between spaced parallel stands or bars 15 and 16. Should a greater bottle carrying capacity be desired, it may be necessary to supply one or more bars in a central area of the device of the subject invention for better support. In the alternative, more bottle engaging units 34 may be utilized than the five parallel units 34 shown in FIGS. 1–3.

Figure 2:
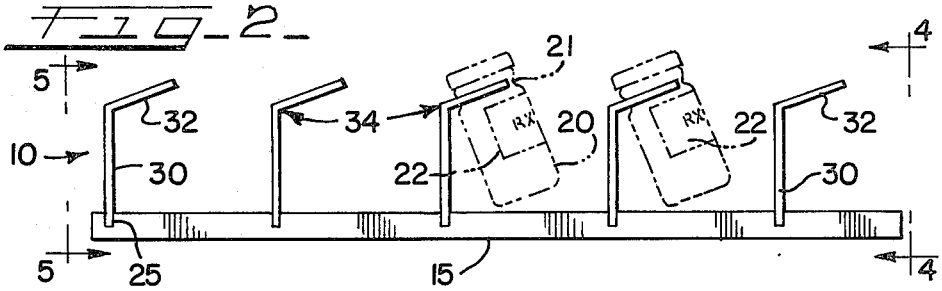
FIG. 2 is a side elevational view of the embodiment of FIG. 1 showing the angle at which each bottle is held.
Figure 3:
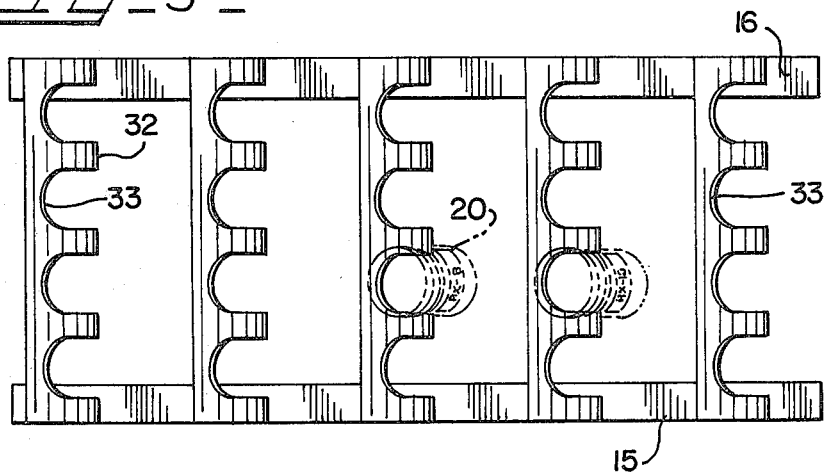
FIG. 3 is a top plan view of the embodiment of FIG. 1 according to the subject invention.
Figure 4:
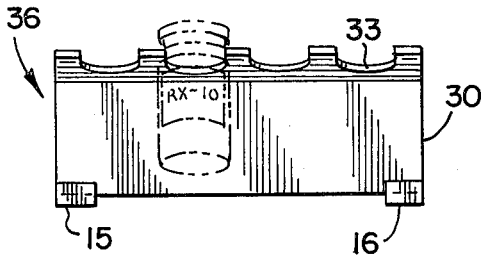
FIG. 4 is a front elevational view of the embodiment shown in FIG. 1.
Figure 5:
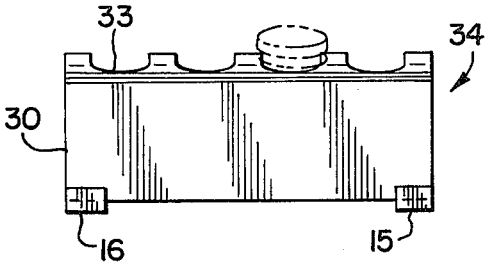
FIG. 5 is a rear elevational view of the embodiment of the subject invention shown in FIG. 1.

Each bottle engaging means 34 comprises a bottom rectangular support 30 (FIGS. 4 and 5) securely mounted at opposite ends in notches 25 and 26 in each of bars 15 and 16 (FIGS. 1 and 2). While support 30 is shown as rectangular, it may take any other suitable shape. Mounted in canvilever-fashion to the upper end of support 30 at an acute angle is bottle engaging portion 32 (FIG. 2). Preferably, bottle engaging portion 32 is secured to support 30 at an angle anywhere from approximately 20° to approximately 50° to the horizontal, for reasons which shall become apparent.

Each bottle engaging member 32 has a plurality of U-shaped openings 33. The U-shaped openings 33 are each of a size that can engage and hold a bottle 20 about the neck 21 of the bottle. Because of the angle in which the bottle engaging member 32 is connected to the support member 30, each bottle is held suspended at an angle.

When initially inserting the bottle into the U-shaped opening 33, care is taken that the bottle label 22 is facing the front. By reason of the angle at which the bottle is held by the bottle engaging member 32, a direct line-of-sight from the lab technician to the label 22 of the bottle 20 is provided, as depicted by the dotted line of FIG. 2. The label 22 of the bottle 20 is fully visible over the top of the bottle 20 of the preceding row because of the angle at which it is held. The visibility thereby attained by the label due to its angled position enables the lab technician to view the indicia on each label of each bottle held by the bottle rack of the subject invention without touching any bottle he may view, and allows him to record the indicia on each bottle in a minimum of time.

Figure 6:
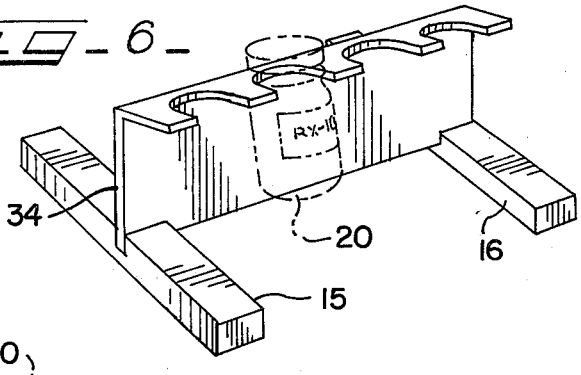
FIG. 6 is a perspective of a second embodiment of the subject invention showing capacity for a single row of bottles; and, FIG. 7 is a third embodiment of the subject invention showing capacity for two rows of bottles.
Figure 7:
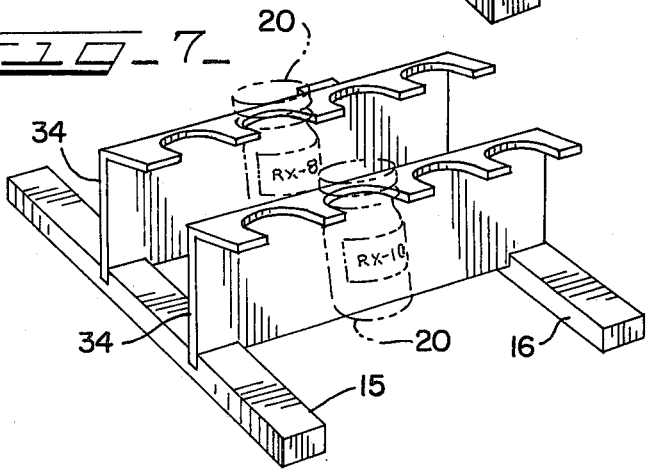

As stated above, the capacity of the subject invention to hold the bottles may be varied to accomodate all manners of use. As shown in FIGS. 6 and 7, if only limited capacity is required, or shelf space is limiting, racks incorporating only one or two bottle engaging members 34 mounted on bars 15 and 16 may be used according to the subject invention. In this manner, as many or as few bottles 20 may be held for processing or storage while allowing the easy reading of the indicia on each bottle without any contact with the bottles being necessary.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out the invention, but that the invention will include all embodiments falling within the scope of the appended claims.

I claim:

1. A bottle rack for the retention of a plurality of bottles having indicia on the body of said bottles in a manner allowing said indicia to be easily read, said bottle rack comprising a pair of spaced parallel longitudinal mounting means, a support member secured in perpendicular fashion to each of said mounting means, a bottle engaging arm secured in cantilever fashion to the upper end of said support member, said bottle engaging arm extending upwardly at an acute angle of about 20° to about 50° to the horizontal and having a plurality of indentations along its length, each of said indentations being of a size to receive and hold a neck of one of said bottles, thereby retaining said bottle at said acute angle for presenting the indicia of said bottle in full view to the user of said rack.

2. The bottle rack of claim 1 wherein a plurality of said racks secured together in spaced parallel relation form a unit.

3. The bottle rack of claim 1 wherein said bottle engaging opening comprises a U-shaped indentation.

4. The bottle rack of claim 1 wherein each of said mounting means support member and bottle engaging arm is formed of an autoclavable plastic material.

5. A bottle rack for the retention of a plurality of bottles having indicia on the body of said bottles in a manner allowing said indicia to be easily read, said bottle rack comprising a pair of spaced parallel longitudinal mounting means, at least two spaced support members attached at a lower end portion at right angles to each of said mounting means, a bottle engaging arm secured in cantilever fashion to an upper end of each of said support members, said bottle engaging arm extending upwardly at an angle of approximately 20° to 50° to the horizontal and having a plurality of U-shaped openings along its length, said U-shaped openings each being of a size to receive and hold a neck of one of said bottles, thereby retaining said bottle at said angle for providing a direct line-of-sight to each of said bottles in full view to the user of said rack.

* * * * *